US005871295A

United States Patent [19]

Bouix

[11] Patent Number: 5,871,295

[45] Date of Patent: Feb. 16, 1999

[54] PUSH-UP LOCKING MASS LIPSTICK CUP

[75] Inventor: Herve Francois Bouix, New York, N.Y.

[73] Assignee: E-L Management Corp., New York, N.Y.

[21] Appl. No.: 878,706

[22] Filed: Jun. 19, 1997

[51] Int. Cl.[6] ..... A45D 40/12

[52] U.S. Cl. ..... 401/78; 401/86; 401/88

[58] Field of Search ..... 401/78, 86–88, 401/98

[56] References Cited

U.S. PATENT DOCUMENTS

| | | | |
|---|---|---|---|
| 656,454 | 11/1900 | Rubira | 401/87 X |
| 1,320,351 | 10/1919 | Purple | 401/98 |
| 2,621,786 | 12/1952 | Schnack | 401/86 |
| 3,082,869 | 3/1963 | Bau | 401/DIG. 1 X |
| 3,146,881 | 9/1964 | Metreaud et al. | 401/86 X |
| 3,175,680 | 3/1965 | Fuglsang-Madsen, et al. . | |
| 3,214,012 | 10/1965 | Mack | 401/87 X |
| 4,417,827 | 11/1983 | Kasai et al. | 401/98 X |
| 4,579,134 | 4/1986 | Moore . | |
| 4,820,070 | 4/1989 | Spatz | 401/87 |
| 5,560,727 | 10/1996 | Vaupel | 401/78 |
| 5,609,430 | 3/1997 | Mazzola et al. | 401/78 X |

FOREIGN PATENT DOCUMENTS

| | | | |
|---|---|---|---|
| 3319031 | 11/1984 | Germany . | |
| 381287 | 10/1932 | United Kingdom | 401/98 |
| 731013 | 6/1955 | United Kingdom | 401/86 |
| WO 96/32031 | 10/1996 | WIPO . | |

*Primary Examiner*—David J. Walczak
*Assistant Examiner*—Kathleen J. Prunner
*Attorney, Agent, or Firm*—Richard LaCava, Esq.

[57] ABSTRACT

The present invention is a holder cup for a stick-type product that prevents the release of the stick-type product from the holder cup. The holder cup comprises a hollow housing which is closed at one end and configured to receive a stick-type product at the other end, said hollow housing having an inner wall and an outer wall, the inner wall containing one or more longitudinal grooves, each longitudinal groove having a first end which is tapered towards the center of the holder cup and a second end which passes through the closed end of the housing to form an aperture. A push-up is then provided, which comprises a base and one or more rods projecting axially outwardly from the base, said rods being positioned to align and dimensioned to fit within the longitudinal groove, and said rods having a length greater than that of the longitudinal groove.

18 Claims, 2 Drawing Sheets

PUSH-UP LOCKING MASS LIPSTICK CUP

FIELD OF THE INVENTION

The present invention relates to a holder cup for a stick-type product that prevents the release of the stick-type product from the holder cup. More particularly, it concerns a holder cup which locks the stick-type product in place to prevent release of the stick-type product from the holder cup upon a shock to the case or upon shrinkage of the stick-type product itself.

BACKGROUND OF THE INVENTION

When stick-type products are placed into their respective cases they are held in place with a holder cup. The means by which the stick-type product is held in the cup is via a friction fit between the stick-type product and the inner wall of the holder cup. These two elements, the holder cup and the stick product, are dimensioned so that a proper friction fit is obtained. The problem with this means of holding the stick-type product in the holder cup is that, over time, the dimensions of the stick-type product will change, thereby causing the friction fit between the cup and the product to be insufficient to hold the product in place during a shock to the case. The dimensions of stick-type products change due to the method of cooling of the product after molding or filling into the holder cup whereby the cooling causes product to shrink.

Also, with the increasing use of volatile ingredients within the formulations for stick-type products, shrinkage problems are a concern. These volatile ingredients tend to evaporate, which then causes the product to shrink. When this happens, a once proper fit between the holder cup and the product will no longer be sufficient to hold the product in place. Once shrinkage has occurred to the point where the fit between the holder cup and the product is insufficient to hold the product in place, a small shock to the case will cause the product to release. Once the product has released from the holder cup it is virtually useless to the consumer.

Current holder cups try to remedy this problem in a number of different ways. Some cups provide a holder wall which protrudes from the bottom of the holder cup, so that when the stick-type product is inserted into the holder cup a greater surface area of contact between the product and the holder cup is provided (see German Patent No. 3,319,031). Along the same premise of increasing the contact surface area, longitudinally extending internal ribs are added to the holder cup as disclosed in U.S. Pat. No. 3,175,680 to Fuglsang-Madsen et al. and U.S. Pat. No. 4,579,134 to Moore. U.S. Pat. No. 4,820,070, provides that the longitudinally extending internal ribs be a dove-tail design to further provide greater contact area and to hold the stick in place after shrinkage of the stick has occurred.

With the new formulations of stick products that contain a considerable amount of volatile ingredients, it has been found that the frictional forces created by these configurations of holder cups is not sufficient to hold the product in place after shrinkage of the stick has occurred and then the case experiences a shock. This insufficient frictional force is created after the stick shrinks because holder cups of the longitudinal rib style pre-form a groove within the stick product when the stick is inserted into the holder cup. The product then shrinks away from the pre-formed groove thereby lessening the contact surface and the frictional forces.

WO Patent No. 96/32031 to Bennett provides for a holder cup that employs the use of a spike which penetrates a lipstick to hold the lipstick in place. This spike is either attached to a snap-ring or an arm. Both embodiments allow the spike to pass through an aperture in the holder cup, thereby puncturing a lipstick. This type of holder cup is effective in holding a stick product in place after shrinkage because a groove is not formed when the product is inserted into the holder cup. Though effective in holding a lipstick in place within a holder cup, these embodiments require additional assembly or may be difficult to manufacture via known holder cup molding techniques.

U.S. Pat. No. 5,560,727 to Vaupel, discloses the use of spring elements provided on the lipstick holder to aid in holding the lipstick mass in place. These spring elements are pressed into the lipstick as the lipstick holder is retracted into the case and form rear-engaging lugs. The disadvantage to this arrangement is that the rear-engaging lugs do not lock in place after they are pressed into the lipstick.

The purpose of the present invention is to provide a holder cup which will secure a stick-type product in place when the case is exposed to a shock.

Another purpose of the present invention is to provide a holder cup that is simple to manufacture.

Another purpose of this invention is to provide a holder cup which will continue to hold a stick-type product in place even after the product changes its dimensions.

Further, it is a purpose of this invention to provide a holder cup which can be used with existing case components with little or no modification to the case.

It is still a further purpose of this invention to provide a holder cup which is a relatively simple device that avoids interference with package aesthetics.

SUMMARY OF THE INVENTION

The present invention is a holder cup for a stick-type product, the cup comprising a hollow housing which is closed at one end and configured to receive a stick-type product at the other end, said hollow housing having an inner wall and an outer wall, the inner wall containing one or more longitudinal grooves, each longitudinal groove having a first end which is tapered towards the center of the holder cup and a second end which passes through the closed end of the housing to form an aperture. A push-up is then provided, which comprises a base and one or more rods projecting axially outwardly from the base, said rods being positioned to align and dimensioned to fit within the longitudinal groove, and said rods having a length greater than that of the longitudinal groove.

In order to secure the stick-type product within the holder cup, the product is first inserted into the housing at the open end. The product is positioned in the housing so that the inserted end of the product is in a position below the tapered end of the longitudinal groove. The rods of the push-up are inserted into the aperture end of the longitudinal grooves. The push-up is then displaced so that the rods travel along the longitudinal grooves. When the outward end of the rod reaches the taper in the longitudinal groove the rod is deflected so that the tip of the rod punctures the stick-type product causing the product to be held in place.

BRIEF DESCRIPTION OF THE DRAWINGS

Further objects, features and drawings of the present invention will better be understood in light of the embodiment examples which are discussed below with the aid of a drawing wherein.

DETAILED DESCRIPTION OF THE INVENTION

Figure 1A:
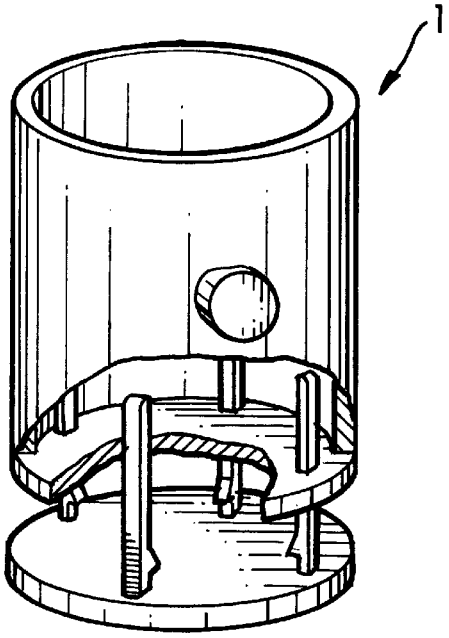
FIG. 1A is an exposed, partially cutaway view of the holder cup of the present invention.

A holder cup has now been devised which prevents the release of a stick-type product from the holder cup upon a shock to the case. This is accomplished through the use of product-piercing rods which hold it in place. FIG. 1A shows an exposed, partially cutaway view of the holder cup 1 of the present invention.

Figure 1B:
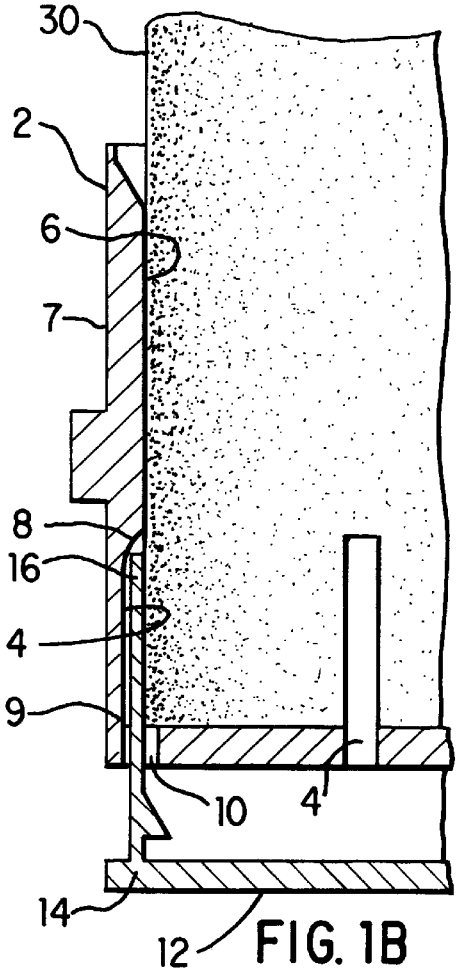
FIG. 1B is a cross-sectional view of the holder cup of FIG. 1A.

FIG. 1B provides a cross-sectional view of the holder cup 1. A hollow housing 2 is provided which is closed at one end, and is configured to receive a stick-type product 30 at the other end. Hollow housing 2, having an inner wall 6 and an outer wall 7, contains one or more grooves 4 extending along the longitudinal axis of inner wall 6. Each groove 4 has a first end 8 and a second end 9. First end 8 of groove 4 is tapered toward the center of housing 2, and second end 9 passes through the closed end of housing 2 to form an aperture 10. A push-up 12 is then provided which comprises a base 14 and one or more rods 16 which project axially upwardly from base 14. Rods 16 are positioned on base 14 so each rod 16 will align with an aperture 10 at the closed end of housing 2.

To obtain the smoothest operation of the cup, groove 4 and rod 16 are of complementary shapes (i.e., the shapes match). A preferred shape of groove 4 and rod 16 is one that will not allow rod 16 to release from the track created by groove 4. FIGS. 3A through 3F illustrate various possible shapes of rod 16 and groove 4. Such shapes include, but are not limited to, square, rectangular, oval, round, semi-circle, and trapezoidal. In a most preferred embodiment, the shape of groove 4 is one that partially encases rod 16, and rod 16 is of a complementary shape. These shapes include, but are not limited to, trapezoidal, semi-circle, round, and oval.

Rods 16 should be flexible enough to be deflected inwardly by the wall of housing 2 at taper 8 in longitudinal groove 4, and stiff enough to pierce the stick-type product 30. The type of material used for rod 16 will vary depending on the type of product needed to be held in place. The material chosen for base 14 and rod 16 will, to a large extent, determine the shape and thickness of rod 16, so that the maximum degree of stiffness and flexibility will be provided to rod 16.

Housing 2 and push-up 12 do not necessarily have to be formed of the same material. For example, housing 2 can be formed of metal, such as aluminum, while push-up 12 can be of a plastic material, such as polypropylene. Also, housing 2 and push-up 12 can be made of different types of plastic, such as an acetal housing with a low density polyethylene push-up. Common materials used in manufacturing stick product housings include polyethylene, polypropylene, acetal, polycarbonate, polyvinylchloride, polyethylene-terephthalate, acrylonitrile-butadiene-styrene, styrene-acrylonitrile, styrene, and the like. The choice of materials for housing 2 or push-up 12 will be guided initially by compatibility with the intended stick product and ease of manufacture, such determinations being within the ordinary skill in the art. The dimensions of rod 16, in order to obtain the proper balance between the desired flexibility and rigidity, will be dependent on the material selected. The proper dimensions to use will be evident to one skilled in the art. The foregoing examples are merely illustrative and should not limit the materials to be used in conjunction with this invention.

In a preferred embodiment, housing 2, base 14 and rod 16 are acetal. Acetal is a material that can easily be molded in a thickness that will impart a significant amount of flexibility to the rods. Also, with the thinness of rod 16, acetal will provide a high degree of chemical resistance to many products.

The present invention, depending on the material selected, can be formed by a number of known processes. For example, when the component is formed of a plastic material, a proper method of manufacture is injection molding. A person of skill in the art will be able to readily determine the method of manufacture that will produce the components of the present invention.

For purposes of clarity the present invention will be described as used in conjunction with a lipstick. This example is merely illustrative, and in no way limits the present invention to lipsticks. It will be apparent to one of ordinary skill in the art how the present disclosure can be adapted for use with any stick product, including, but not limited to, deodorants, lip balms, make-up foundations, clear cosmetic sticks, anti-acne sticks, antiperspirant, solid perfume, concealer, eyeshadow, blush, sunscreen, and the like.

The molding and assembly of a lipstick involves a number of steps. First, the molten mass of a lipstick is poured into a mold and allowed to cool. Second, a portion of the mold is removed whereby the base of the lipstick is exposed. Next, a pre-assembled lipstick case 40 is provided. This case is usually of the swivel-type which has the holder cup in the upper-most position within the case (i.e., the cup is in the position it would be in if the case contained a lipstick and that lipstick was swiveled to a position where the greatest amount of the lipstick would be exposed from the case). The case is placed so that the cup is aligned with the base of the lipstick, and then driven so that the base of the lipstick is forced into the cup. Finally, the cup is repelled into the case and a cover is placed over the case.

In a preferred embodiment holder cup 1 of the present invention is pre-assembled and placed into this swivel-type lipstick case 40. When the case 40 is assembled, the cup is in the upper-most position within the case so that the cup can receive a lipstick. In this embodiment housing 2 and push-up 12 are assembled so that rods 16 are resting in longitudinal groove 4. At this point, the upper end of rods 16 do not reach taper 8 in longitudinal groove 4. As illustrated by FIG. 1B, this causes the tip of rod 16 to remain flush with the inner wall 6 of housing 2 where it will not interfere with the lipstick as the lipstick is inserted into housing 2.

The lipstick is then inserted into the open end of housing 2 to a point where the inserted end of the lipstick is in a position below taper 8 in longitudinal groove 4. The insertion of the lipstick to this point is important because if the lipstick is not inserted to at least this point the lipstick will not be in a position where rod 16 can pierce it, thereby holding the lipstick in place.

With the lipstick 30 in place, holder cup 1 is then mechanically driven into the case 40 so that push-up 12 engages an internal surface 41 of the case 40. Typically, the internal surface 41 of the case 40 will be the internal base of the lipstick case 40 itself, or, for example, a platform provided within the base of the case for the purpose of actuating push-up 12. When push-up 12 engages the internal surface 41 of the case 40, base 14 of push-up 12 is driven towards housing 2 which causes rod 16 to travel along longitudinal groove 4 until the upper end of rod 16 reaches taper 8 in groove 4. At this point rod 16 is deflected inwardly so that the tip of rod 16 punctures the lipstick 30 causing the lipstick to be held in place. Typically, the tip of rod 16 will pierce the product for a distance of about 1.0 millimeters to about 3.0 millimeters.

The inside of the lipstick case 40 is provided with an internal surface 41 that actuates push-up 12. This interaction of the internal surface 41 and push-up 12 occurs as holder cup 1 is repelled into the case. The internal surface 41 can be the base of the case 40, or, depending on the configuration of the case 40, it can be an insert or additional piece which is placed inside the case during assembly. It will be apparent to one of skill in the art of lipstick case manufacture what modifications, if any, will be needed.

In another embodiment, holder cup 1 is not pre-assembled into a lipstick case. In this embodiment the lipstick is molded in its usual fashion and the cup of the present invention will be placed over the base of the lipstick before the cup is pre-assembled into the case. After the cup is placed over the base of the lipstick push-up 12 is then displaced so that rod 16 travels along groove 4 and punctures the lipstick in the same manner as described above. The displacing of push-up 12 can either be accomplished manually with a finger or by a machine. With the cup in place on the lipstick, the lipstick can then be removed from the mold and then placed within a case.

This embodiment of the present invention is especially useful with a disposable or refillable-type case, wherein holder cup 1 is configured so that it will be detachably secured within the case so that holder cup 1 and the stick product form a cartridge capable of being removed as a unit, thrown away, and replaced by a new unit. Refillable cases are described, for example, in British Patent No. 731,013, the contents of which are herein incorporated by reference. The modifications required to adapt the present invention for use within any type of refillable case would be apparent to one of ordinary skill in the art.

Figure 2A:
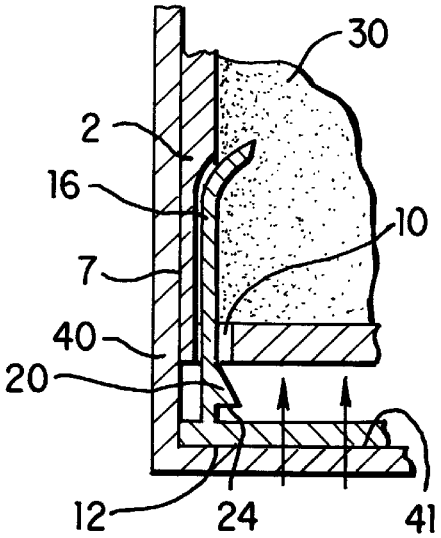
FIGS. 2A and 2B show the operation of the holder cup whereby the push-up is displaced toward the housing causing the rods to pierce the stick product and lock in place.
Figure 2B:
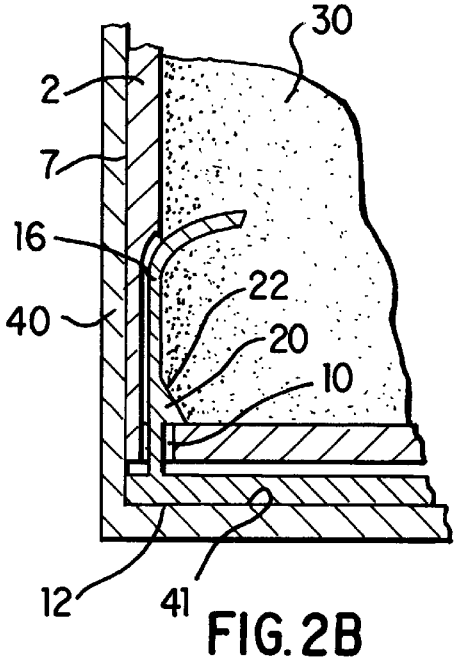
Figure 3A:
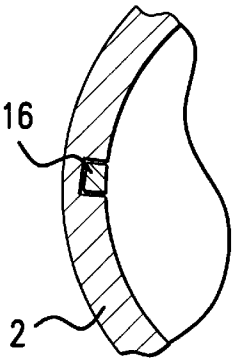
FIGS. 3A through 3F show various configurations of the rod and groove.
Figure 3B:
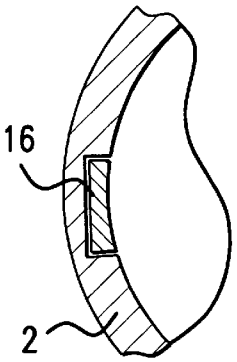
Figure 3C:
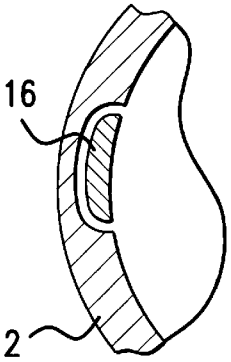
Figure 3D:
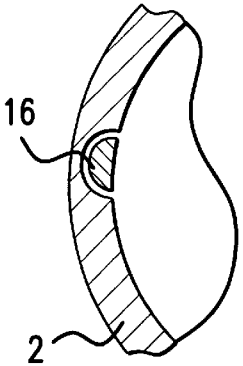
Figure 3E:
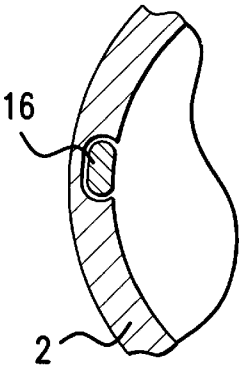
Figure 3F:
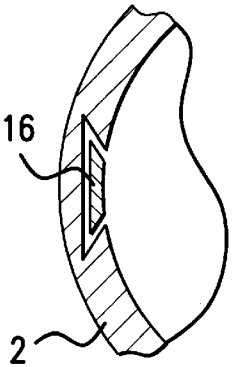

In a preferred embodiment, the present invention is fitted with a locking mechanism whereby push-up 12 is locked in place within housing 2 after rods 16 have engaged the stick-type product 30 (see FIGS. 2A and 2B). The locking mechanism prohibits rod 16 of push-up 12 from moving after engaging the product, thus preventing rod 16 from releasing the product. This is accomplished through the use of a hook 20 which is disposed on rod 16. Hook 20 is designed so that it will easily pass through aperture 10 in housing 2 as rod 16 travels along groove 4, but will not be able to pass back through aperture 10 in the opposite direction. Since push-up 12 is formed of a flexible material, hook 20 disposed on rod 16 will also be flexible and will deform slightly so as to fit through aperture 10, and upon passage through aperture 10, hook 20 will return to its original shape. For example, hook 20 can be wedge-shaped, whereby the upper surface 22 is at an angle that allows passage through aperture 10, and the lower surface 24 is approximately perpendicular to the longitudinal axis of rod 16, thus preventing passage back through aperture 10 in the opposite direction and effectively locking push-up 12 in place.

I claim:

1. A holder cup for a stick-type product, wherein the cup comprises:

a hollow housing which is closed at one end and configured to receive the stick-type product at the other end, said hollow housing having an inner wall and an outer wall, the inner wall containing one or more longitudinal grooves, each longitudinal groove having a first end which is tapered towards the center of the housing and a second end which passes through the closed end of the housing to form an aperture; and a push-up having a base and one or more rods projecting axially outwardly from the base, each rod being positioned to align and dimensioned to fit within a longitudinal groove, and being of a length greater than that of the longitudinal groove.

2. A holder cup as in claim 1, wherein a stick-type product is placed within the holder cup.

3. A holder cup as in claim 2, wherein the stick-type product is a lipstick, lip balm, deodorant, antiperspirant, solid perfume, concealer, make-up foundation, eyeshadow, blush, acne treatment product, or sunscreen.

4. A holder cup as in claim 1, wherein a locking mechanism is disposed on the rods of the push-up.

5. A holder cup as in claim 4, wherein the locking mechanism is a hook which allows the push-up to lock in place after the rods have engaged the product.

6. A holder cup as in claim 5, wherein the hook is wedge-shaped.

7. A holder cup as in claim 1, wherein the housing and the push-up are the same material.

8. A holder cup as in claim 1, wherein the housing and the push-up are different materials.

9. A holder cup as in claim 1, wherein the holder cup is pre-assembled into a case.

10. A holder cup as in claim 9, wherein the case contains an internal surface that engages the push-up of the holder cup.

11. A case comprising:

a holder cup disposed within the case and containing a stick-type product, wherein the holder cup comprises:

a hollow housing, said housing being closed at one end and configured to receive the stick-type product, said housing having an inner wall and an outer wall, the inner wall containing one or more longitudinal grooves, each groove having a first end which is tapered towards the center of the housing and a second end which passes through the closed end of the housing to form an aperture; and a push-up having a base and one or more rods projecting axially outwardly from the base, each rod passing through an aperture in the housing and aligned and fitting within a longitudinal groove, and being of a length greater than that of the longitudinal groove so that the outward tip of each rod penetrates the product.

12. A case according to claim 11, wherein the case contains an internal surface that engages the push-up of the holder cup.

13. A case according to claim 11, wherein a locking mechanism is disposed on the rods of the push-up.

14. A case according to claim 13, wherein the locking mechanism is a hook which allows the push-up to lock in place after the rods have engaged the product.

15. A case according to claim 14, wherein the hook is wedge-shaped.

16. A case according to claim 11, wherein the stick-type product is a lipstick, lip balm, deodorant, antiperspirant, solid perfume, concealer, make-up foundation, eyeshadow, blush, acne treatment product, or sunscreen.

17. A case according to claim 11, wherein the housing and the push-up are the same material.

18. A case according to claim 11, wherein the housing and the push-up are different materials.

* * * * *